United States Patent [19]

Jahr et al.

[11] Patent Number: 4,483,169

[45] Date of Patent: Nov. 20, 1984

[54] DOUBLE ROLLER GUIDE FOR ROLLING MILLS

[75] Inventors: Alfred Jahr, Krefeld; Wilhelm Svihel, Neusiedl a. See, both of Fed. Rep. of Germany

[73] Assignee: Centrol-Morgardshammer GmbH, Krefeld, Fed. Rep. of Germany

[21] Appl. No.: 477,753

[22] Filed: Mar. 22, 1983

[30] Foreign Application Priority Data

Sep. 16, 1982 [DE] Fed. Rep. of Germany ..... 8226070

[51] Int. Cl.[3] ..... B21B 39/14

[52] U.S. Cl. ..... 72/250; 226/189; 226/198; 226/199

[58] Field of Search ..... 72/250, 251; 226/189, 226/190, 198, 199

[56] References Cited

U.S. PATENT DOCUMENTS

| | | | |
|---|---|---|---|
| 2,976,749 | 3/1961 | Albedyhl | 72/251 |
| 4,212,181 | 7/1980 | Shimada | 72/250 |
| 4,295,356 | 10/1981 | Fabris | 72/250 |

FOREIGN PATENT DOCUMENTS

| | | | |
|---|---|---|---|
| 909922 | 4/1954 | Fed. Rep. of Germany | 72/250 |

*Primary Examiner*—Lowell A. Larson
*Assistant Examiner*—Jorji M. Griffin
*Attorney, Agent, or Firm*—Shlesinger Arkwright Garvey & Fado

[57] ABSTRACT

The invention concerns a double roller guide for rolling mills, consisting of at least two guide rollers positioned in series in the direction of rolling and mounted on associated roller carriers positioned so that they can pivot and be adjusted according to the position of the guide rollers. In order to make it possible to position the guide rollers in the same direction and in parallel, the roller carriers are two-armed pivoted levers at the one end of which the guide roller is mounted and the other end of which is supported on an adjustable stop, whereby the transmission ratios of both roller carriers are equal and the end of one roller carrier is supported on the other roller carrier at a distance from its pivoting axis.

10 Claims, 2 Drawing Figures

DOUBLE ROLLER GUIDE FOR ROLLING MILLS

Figure 1:
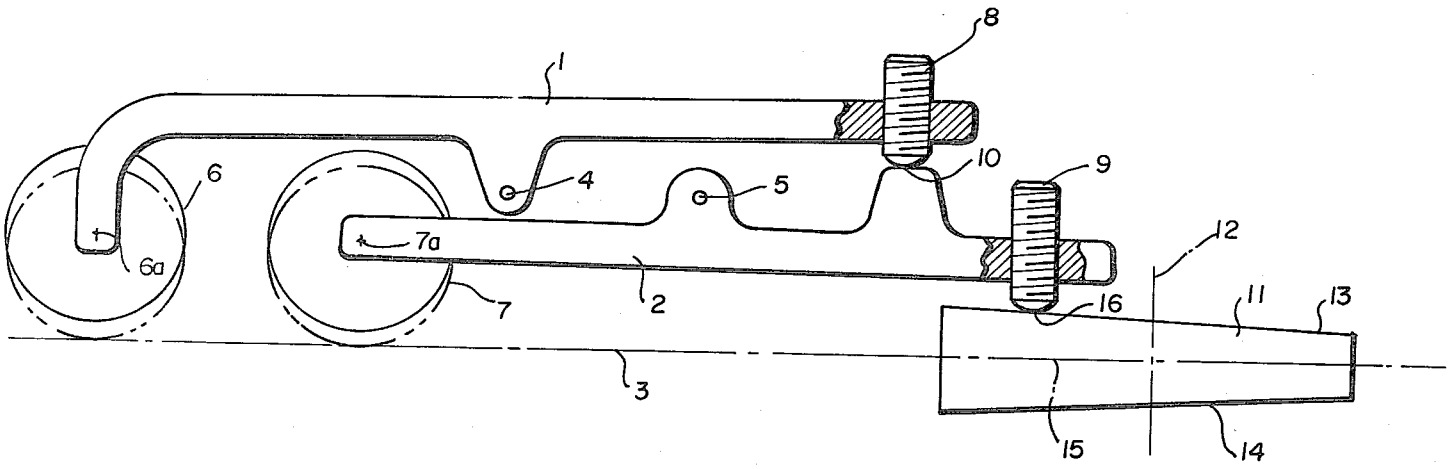

The invention concerns a double roller guide for rolling mills, consisting of at least two guide rollers positioned in series in the direction of rolling and mounted on associated roller carriers positioned so that they can pivot and be adjusted according to the position of the guide rollers.

In various rolling processes, e.g. with open roll trains and with continuous roll trains with loop regulation the roller guide should also produce a certain directing effect. For this reason, instead of one roller pair two roller pairs are put together to a double roller guide. Double roller guides are known in various constructions.

The spreading effects of the rolling stock change during the rolling process according to the quality of rigidity and the rolling temperature.

It is frequently required, especially for high-quality steel rolling mills, that the guides can be adjusted rapidly and in an uncomplicated fashion, in order to be adapted to the changed conditions of the rolling stock at a quality change. It is also important in a double roller guide that the series-connected rollers are adjusted parallel to each other on one side of the rolling stock. No suitable device exists for this.

The invention has the task of improving a double roller guide of the type initially described in such a manner that at least two rollers connected in series in the direction of rolling, and in the case of roller pairs positioned on both sides of the rolling stock all four rollers can be positioned centrally and in parallel.

The invention solves this task as follows: The roller carriers are two-armed pivoted levers at the one end of which the guide roller is mounted and the other end of which is supported on an adjustable stop, whereby the transmission ratios of both roller carriers are equal and the end of one roller carrier is supported on the other roller carrier at a distance from its pivoting axis.

In the doule roller guide of the invention the roller carriers form a lever transmission, because the end of the one roller carrier is also the adjustable stop for the end of the other roller carriers. It is therefore sufficient to adjust one of the roller carriers in order that the other roller carrier is adjusted in the same way and that both guide rollers are positioned in parallel.

In particular, the distances of the axis of rotation of the guide roller to the pivoting axis of the roller carrier on the one hand and of the pivoting axis of the roller carrier to the adjustable stop on the other hand of both roller carriers should be equal. This results in a type of parallelogram guide, whereby, however, both roller carriers are mounted only in the area of their pivoting axes and other wise are supported on the adjustable stops as well as over the guide roller on the rolling stock. It is advantageous if the spacing of the adjustable stops (in the direction of rolling) is equal to the spacing of the pivoting axes (in the direction of rolling).

The adjustable stop for the one roller carrier can be a cam disk. Rotating the cam disk causes the end of the roller carrier supported on it to be pivoted to a greater or lesser extent and the associated guide roller of the roller carrier to be positioned in the opposite direction. The same applies to the other roller carrier, which obligatorily follows the movement of the end supported on the cam disk.

The axis of rotation of the cam disk should be positioned orthogonally to the pivoting axes of the roller carriers, whereby the cam disk has a support surface on at least one side with a distance from the central plane of the cam disk which can be varied in a circumferential direction. If the double roller guide has two guide rollers only on one side of the rolling stock, it is sufficient if the cam disk has a support surface on one side.

The cam disk can also have support surfaces on both sides, which surfaces are mirror-symmetric to one another, so that a roller carrier of a double roller guide with four guide rollers can be supported on each support surface. Since the support surfaces are mirror-symmetric to one another, when the cam disk is rotated, all four guide rollers of a double roller guide are positioned in the same direction and in parallel.

A particularly simple embodiment of the invention is characterized in that the support surfaces are plane. The cam disk then has a wedge-shaped cross section. It is easy to machine.

In order that the position of the guide rollers does not change during operation, a setting device for the cam disk can be provided. It can be, for example, a tightening screw with which the cam disk is held fast.

At least one spring can also be provided which presses the roller carriers against their associated stops.

In order to compensate manufacturing tolerances and to obtain a presetting capability, the supported ends of the roller carriers can have adjusting screws over which they are supported on the associated stops.

An embodiment of the invention is shown in the drawing and described below.

Figure 2:
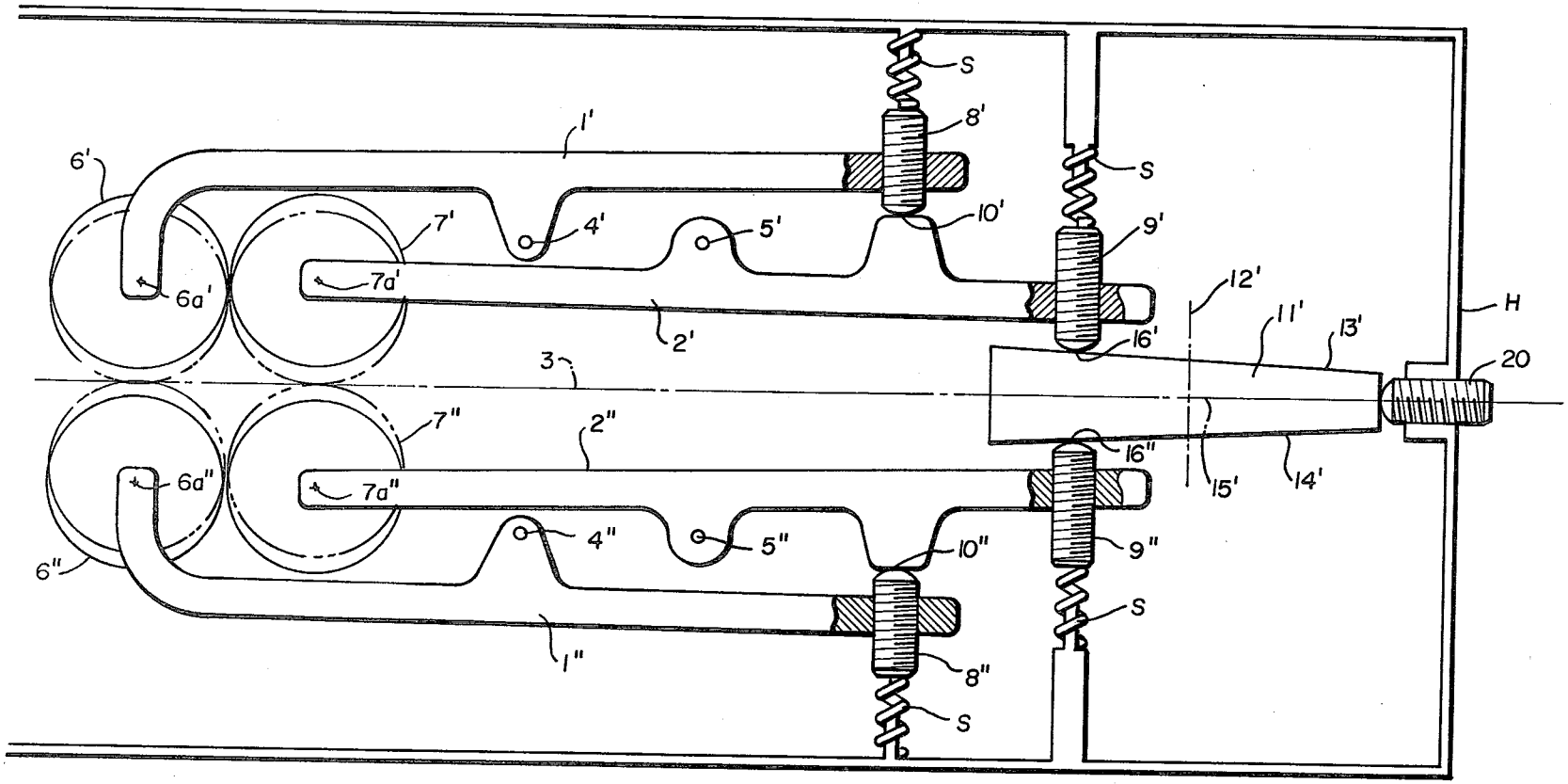

FIG. 1 schematically shows a partial view of a double roller guide for a rolling mill; and, FIG. 2 is another schematic view similar to that of FIG. 1 disclosing another embodiment of the invention.

The double roller guide shown has the function of introducing rolling stock (not shown) into the roll pass. The double roller guide is positioned in a housing (not shown) or on a carrier frame (not shown). Only one half of the double roller guide with two roller carriers, 12 is shown. Two other roller carriers (not shown) are positioned in a mirror image to central line 3.

Each roller carrier 1,2 is mounted in a housing or on a carrier frame so that it can pivot about pivoting axis 4,5. A guide roller 6,7 for the rolling stock is rotatably mounted on the left (according to the figure) end of each roller carrier 1,2. An adjusting screw 8,9 is held in an associated threaded bore at the right (according to the figure) end of each roller carrier 1,2, which screws extend orthogonally to pivoting axes 4,5. Adjusting screw 8 of outer roller carrier 1 is supported on an associated stop 10 of inner roller carrier 2. Adjusting screw 9 of inner roller carrier 2 is supported on rotatable cam disk 11, whose axis of rotation extends orthogonally to pivoting axes 4 and 5. Adjusting screw 9 engages cam disk 11 at contact point 16.

Cam disk 11 has a wedge-shaped cross section, so that plane support surfaces 13,14 are formed on both sides which have the same distance from central plane 15 of cam disk 11 in the same coordinates. The roller carrier of the other roller carrier pair is supported on support surface 14 in a corresponding manner and in a mirror image.

It is not shown that at least one spring is provided which presses roller carrier 1,2 against their associated stops 10,13. It is also not shown that cam disk 11 can have a measuring scale on its outer periphery as well as one or more shoulders for a tool for rotating cam disk 11. A setting device, e.g. a tightening screw (not shown), is provided so that cam disk 11 does not rotate during operation.

The transmission ratios of both roller carriers 1,2 are equal in the double roller guide shown. In addition, the distance of the axes of rotation 6A and 7A, respectively of guide roller 6,7 from pivoting axis 4,5 of the associated roller carrier 1,2 are equal and the distances of pivoting axis 4,5 of roller carriers 1,2 from adjustable stops 10,11 are also equal. Moreover, the spacing of stops 10 and 11 is equal to the spacing of pivoting axes 4 and 5.

This creates a kind of parallelogram guide which makes it possible to adjust guide rollers 6,7 and the guide rollers (not shown) of the other side in the same direction and evenly parallel by rotating cam disk 11. This is indicated for guide rollers 6,7 by dotted lines.

Adjusting screws 8,9 have the function of compensating manufacturing tolerances and also of presetting the parallelism of guide rollers 6,7 in relation to the rolling stock.

FIG. 2 discloses another embodiment of the double roller guide of FIG. 1 wherein a mirror image of the roller carriers 1 and 2 are provided on the opposite side of the embodiment of FIG. 1. Like numerals designate like parts with a prime sign indicating like parts of FIG. 1 with a double prime indicating similar like parts in FIG. 2.

The roller guides 1', 2' and 1'' and 2'' are disposed in housing H. Housing H contains a tightening screw 20 which is adapted for engaging cam disk 11 so as to prevent rotation during operation. Springs S are disposed in housing H and are adapted for pressing the roller carriers 1', 2' and 1'', 2'' against their associated stops 10', 16' and 10'', 16'', respectively.

It should be noted in FIG. 2, that the distance from the axis of rotation 6A' to pivot axis 4' is equal to the distance from axis of rotation 7A' to pivot axis 5'. Similarly, the distance from pivot axis 4' to contact point 10' is equal to the distance from pivot axis 5' to contact point 16'. A similar distance characterization is also provided for the roller carriers 1'' and 2'' although it should be obvious to one skilled in the art that the distance for carriers 1'' and 2'' may be dissimilar from that of carriers 1' and 2'. This is contrasted with FIG. 1 wherein the distance from axis of rotation 6A to pivot axis 4 is different from the distance between axis of rotation 7A and pivot axis 5. In FIG. 1, however, the distance from pivot axis 4 to contact point 10 is equal to the distance from axis of rotation 6A to pivot axis 4. Similarly, the distance from pivot axis 5 to contact point 16 is equal to the distance from pivot axis 5 to axis of rotation 7A.

We claim:

1. Double roller guide for rolling mills, consisting of at least two guide rollers positioned in series in the direction of rolling and mounted on associated roller carriers positioned so that they can pivot and be adjusted according to the position of the guide rollers, characterized in that the rollers carriers (1,2) are two-armed pivoted levers at the one end of which the guide roller (6,7) is mounted and the other end of which is supported on an adjustable stop (10,11), whereby the transmission ratios of both roller carriers (1,2) are equal and the end of one roller carrier (1) is supported on the other roller carrier (2) at a distance from its pivoting axis (5).

2. A double roller guide as defined in claim 1, wherein:

(a) said adjustable stop and said axis of rotation of each of said roller carriers are substantially equidistant the associated pivot axis.

3. The double roller guide as defined in claim 2, wherein:

(a) each of said adjustable stops is spaced an equal distance from the associated pivot axis.

4. The double roller guide as defined in claim 1, wherein:

(a) said adjustable stop for at least one of said roller carriers is a cam disk.

5. The double roller guide as defined in claim 4, wherein:

(a) said cam disk is rotatable on an axis orthogonal to said pivot axes; and, (b) said cam disk includes a support surface providing said adjustable stop extending generally angularly from a center plane whereby rotation of said cam disk on said axis causes a variation in distance of said adjustable stop from said center plane.

6. The double roller guide as defined in claim 5, wherein:

(a) said cam disk includes a support surface on two opposed sides thereof; and, (b) two of said roller carriers are associated with each of said support surfaces.

7. The double roller guide as defined in claim 6, wherein:

(a) said support surfaces are planar.

8. The double roller guide as defined in claim 5, wherein:

(a) said cam disk is disposed in a housing; and, (b) a setting device is associated with said housing and is engagable with said cam disk for preventing rotation thereof during operation of said roller guide.

9. The double roller guide as defined in claim 8, wherein:

(a) at least a first spring is disposed in said housing and engages at least one of said roller carriers for thereby pressing said at least one roller carrier against the associated adjustable stop thereof.

10. The double roller guide as defined in claim 1, wherein:

(a) an adjusting screw is connected to a first end of each of said roller carriers and is adapted for supporting said roller carrier on said adjustable stops.

* * * * *